US011603256B2

(12) United States Patent
Smith

(10) Patent No.: US 11,603,256 B2
(45) Date of Patent: Mar. 14, 2023

(54) DEVICE TO SPRAY OMNIDIRECTIONALLY AND AVOID BACKFLOW

(71) Applicant: Jesse Lee Smith, Kapaa, HI (US)

(72) Inventor: Jesse Lee Smith, Kapaa, HI (US)

( * ) Notice: Subject to any disclaimer, the term of this patent is extended or adjusted under 35 U.S.C. 154(b) by 252 days.

(21) Appl. No.: 16/998,874

(22) Filed: Aug. 20, 2020

(65) Prior Publication Data

US 2021/0053745 A1 Feb. 25, 2021

Related U.S. Application Data

(60) Provisional application No. 62/890,170, filed on Aug. 22, 2019, provisional application No. 62/890,176, filed on Aug. 22, 2019, provisional application No. 62/890,172, filed on Aug. 22, 2019.

(51) Int. Cl.

| | |
|---|---|
| ***B65D 83/30*** | (2006.01) |
| ***B05B 11/00*** | (2023.01) |
| ***B05B 9/08*** | (2006.01) |
| ***B05B 15/652*** | (2018.01) |

(52) U.S. Cl.

CPC ..... *B65D 83/303* (2013.01); *B05B 9/0883* (2013.01); *B05B 11/0091* (2013.01); *B05B 15/652* (2018.02)

(58) Field of Classification Search

CPC ..... B65D 83/303; B65D 83/20; B65D 83/24; B65D 83/756; B65D 83/207; B05B 9/0883; B05B 11/0091; B05B 15/652

See application file for complete search history.

(56) References Cited

U.S. PATENT DOCUMENTS

| | | | | |
|---|---|---|---|---|
| 2,968,441 | A | 1/1961 | Holcomb | |
| 3,305,144 | A * | 2/1967 | Beres | B65D 83/756 251/95 |
| 3,428,224 | A * | 2/1969 | Douglas | B65D 83/756 222/529 |
| 3,650,438 | A * | 3/1972 | Stephenson | B65D 83/756 222/402.22 |
| 4,350,299 | A * | 9/1982 | Stephenson | B65D 83/756 239/588 |
| 4,895,280 | A * | 1/1990 | Tourigny | B65D 83/60 285/82 |
| 4,928,859 | A | 5/1990 | Krahn et al. | |
| 5,110,231 | A * | 5/1992 | Monteith | B65D 83/756 401/207 |
| 8,690,024 | B2 | 4/2014 | Sogaro | |
| 9,061,299 | B1 | 6/2015 | Fodor | |
| 10,065,791 | B1 | 9/2018 | Charles | |
| 2005/0061014 | A1 | 3/2005 | Cannan | |
| 2006/0060614 | A1 | 3/2006 | Garner | |
| 2007/0181610 | A1 | 8/2007 | Fazekas et al. | |
| 2009/0308946 | A1 | 12/2009 | Dube et al. | |
| 2011/0240771 | A1 | 10/2011 | Legeza | |
| 2018/0037400 | A1 | 2/2018 | Kuntzelman | |

* cited by examiner

*Primary Examiner* — Vishal Pancholi
(74) *Attorney, Agent, or Firm* — Keri Ann K. S. Krzykowski; Martin E. Hsia

(57) ABSTRACT

A device to allow for the continuous spraying of pressurized liquid from an aerosol spray can at any angle required, and in locations that can only be accessed through an openings through which an aerosol spray can does not fit, all while automatically preventing backflow of the pressurized liquid through the device.

10 Claims, 5 Drawing Sheets

DEVICE TO SPRAY OMNIDIRECTIONALLY AND AVOID BACKFLOW

RELATED APPLICATIONS

This application claims the priority of U.S. provisional patent application No. 62/890,176, filed on Aug. 22, 2019; U.S. provisional patent application No. 62/890,170, filed on Aug. 22, 2019; and U.S. provisional patent application No. 62/890,172, filed on Aug. 22, 2019.

TECHNICAL FIELD

Aerosol spray cans contain a liquid (fluid) to be sprayed, and a pressurized gas (propellant gas). Because it is lighter, the pressurized gas is usually above the fluid when the can is upright. A dip tube extends from the top of the can, downwards to the bottom of the can, so that when the can is upright and an actuator at the upper end of the dip tube is pressed, a valve (also at the upper end of the dip tube) opens, and the pressure of the propellant gas impels the liquid (fluid) up the dip tube and out the upper end, through the actuator.

One of the problems with using aerosol spray cans is that they cannot continuously spray the liquid (fluid) under pressure from the propellant gas (pressurized liquid) when the aerosol spray can is oriented so that the dip tube does not extend into the pressurized liquid. Use of the aerosol spray can in such circumstances will result in the spraying of propellant gas with an inconsistent amount of pressurized liquid, only the propellant gas, or, if the propellant gas is depleted, nothing at all. This therefore disrupts the continuous spraying of pressurized liquid from the can.

Another problem with conventional aerosol spray cans is that it is sometimes desired to spray the pressurized liquid onto a location that can be accessed only through an opening through which the aerosol spray can does not fit. In such circumstances, it is not possible to completely and accurately spray that location through the opening using conventional aerosol spray cans.

In the past, to address these shortcomings, others have used devices with distal actuators and distal spray nozzles attached to a flexible hose that attaches to, and is in fluid communication with, an aerosol spray can. However, when such devices are disconnected from the aerosol spray can, the propellant gas in the can no longer applies pressure within the flexible hose toward the distal actuator and spray nozzle and away from the aerosol spray can. This lack of pressure causes backflow—that is, the pressurized liquid left within the flexible hose travels backwards toward the aerosol spray can and the area of lower pressure, and the liquid leaks or disperses from the device and lands in unintended and undesired locations.

Accordingly, it is an object of the present invention to provide a device for the continuous spraying of pressurized liquid from an aerosol spray can by using a distal actuator that is located apart from the aerosol spray can, so that the spray can remains in a substantially upright position while in use.

It is another object of the present invention to provide a device for the spraying of pressurized liquid from an aerosol spray can using a distal spray nozzle that is located apart from the aerosol spray can, so it can fit into locations that cannot be accessed by the can itself.

It is a further object of the present invention to provide a device for the spraying of pressurized liquid from an aerosol spray can, such that the device automatically prevents backflow of pressurized liquid toward the aerosol spray can when the device is disconnected from the aerosol spray can.

BACKGROUND ART

The following prior art references may be relevant to the present invention:

U.S. patent application Ser. No. 11/228,165 (Pat. App. Pub. No. 2006/0060614) to Garner ("Garner"), incorporated herein by reference, discloses a remote aerosol dispensing system that attaches to an aerosol spray can via an aerosol mounting cup assembly adapter, and utilizes an aerosol valve actuator insert adapter, into which an aerosol valve actuator insert is inserted, and all of which are fluidly connected through a flexible delivery tube to a remote spray medium. The remote spray medium dispenses the contents of aerosol spray can by a remote external medium regardless of the angle of application. However, Garner does not disclose a mechanism for automatically preventing backflow of the contents from the flexible delivery tube when the aerosol valve actuator insert is removed from the aerosol valve actuator insert adapter.

U.S. Pat. No. 4,928,859 to Krahn et al. ("Krahn"), incorporated herein by reference, discloses a coupling assembly or quick connect/disconnect assembly for interconnecting a hose and a source of fluid under pressure, such as an aerosol can of solvent. However, Krahn does not disclose a mechanism for remotely actuating spray at a distal end of the hose, nor does it disclose a mechanism for automatically preventing the backflow of the fluid under pressure from the proximal end of the hose when the hose is disconnected from the assembly.

U.S. patent application Ser. No. 10/665,213 (Pat. App. Pub. No. 2005/0061014) to Cannan ("Cannan"), incorporated herein by reference, discloses an extension for the top of a refrigerant can for dispensing the pressurized refrigerant therein. The extension includes a seal over the opening of the refrigerant can with a valve stem that extends through the seal. The extension includes an actuator cap that fits over the seal on the top of the canister. The extension is in fluid connection with a charging hose through which the extension dispenses refrigerant from the refrigerant can. The actuator cap houses an actuator for releasing the contents of the container. The extension allows the contents of the refrigerant can to be delivered without having to attach a manual shutoff valve to the canister. However, Cannan does not disclose an actuator at the distal end of the charging hose, nor does it disclose a mechanism for automatically preventing the backflow of refrigerant from a proximal end of the charging hose when the extension is disconnected from the refrigerant can, or when the charging hose is disconnected from the actuator cap.

U.S. Pat. No. 10,065,791 to Charles ("Charles"), incorporated herein by reference, discloses an aerosol applicator system having a user configurable spray direction, having an aerosol can with a valve stem extending from a valve, a valve actuator mechanically connected to the valve, a flexible tube coupled to the valve actuator, and a nozzle coupled at a second end of the flexible tube. However, Charles does not disclose an actuator at the distal end of the flexible tube, nor does it disclose a mechanism for automatically preventing backflow when the valve actuator is removed from the valve stem of the aerosol spray can.

U.S. patent application Ser. No. 10/586,833 (Pat. App. Pub. No. 2007/0181610) to Fazekas et al. ("Fazekas"), incorporated herein by reference, discloses an adapter for aerosol cans having a receiving device for the valve of the aerosol can, a conveying tube arranged at the receiving device, a connection on the conveying tube to accommodate a trunk used to enable the can content to be discharged in a well-aimed manner, a handle to actuate the receiving device counter to the valve of the can, holding means for fixing the adapter to a crimping lip of the dome of the can, with the receiving device interacting with and having a sealing effect on the valve disk of the aerosol can and the receiving device being flexibly integrated into the adapter. However, Fazekas does not disclose a mechanism for automatically preventing the backflow of fluid when the adapter is disconnected from the aerosol can or remote actuating means.

U.S. Pat. No. 8,690,024 to Sogaro ("Sogaro"), incorporated herein by reference, discloses a spray can comprising a discharge tube, having a can member for holding a material to be sprayed, a spray head that is plugged onto a can valve on the top face of the can member and fitted with a discharge tube, and an adapter that connects the spray head to the discharge tube. However, Sogaro does not disclose a mechanism for automatically preventing the backflow of liquid from the delivery tube when the delivery tube is not disconnected from the adapter, nor does it disclose remote actuating means.

U.S. patent application Ser. No. 12/136,974 (Pat. App. Pub. No. 2009/0308946) to Dube et al. ("Dube"), incorporated herein by reference, discloses an aerosol can adaptor for spraying equipment. Specifically, Dube discloses a system for spraying a material, the system comprising: a canister having a first threaded fitting in fluid communication with a valve seal; a dip tube extending from the valve seal into the canister; an adaptor having a second threaded fitting that mates with the threads of the first threaded fitting and an adaptor tube; and, a nozzle in fluid communication with the adaptor; wherein the adaptor tube interacts with the valve seal to move the valve into an open position, thereby establishing a continuous flow path from the canister to the nozzle through the dip tube, valve seal and adaptor tube. However, Dube does not disclose a mechanism for automatically preventing the backflow of liquid from the adaptor when the adaptor is disconnected from the canister, nor does it disclose the use of a hose or tube and distal spray nozzle and distal actuator to remotely actuate and spray the contents from a distance apart from the canister.

U.S. Pat. No. 9,061,299 to Fodor ("Fodor"), incorporated herein by reference, discloses a "spray paint can spraying accessory" that attaches onto an existing can of spray paint, and which is able to direct paint inwardly around a focal point in order to paint a cylindrical or circular object. The spray paint can accessory includes a nozzle housing that attaches atop of a spray paint can, and a can nozzle that attaches onto the outlet tube of the existing spray paint can. A spray gun hose connects with the can nozzle to direct paint to a spray gun having a plurality of paint nozzles positioned along an assembly, and which direct paint inwardly around a focal point. The assembly and paint nozzles include an opening to enable ingress and egress of the object to be painted. The can nozzle housing includes a threaded member that upon rotation engages the can nozzle downwardly thereby operating the outlet tube of the spray paint can. However, Fodor does not disclose a mechanism for automatically preventing the backflow of liquid from the accessory when it is disconnected from the canister.

U.S. Pat. No. 2,968,441 to Holcomb ("Holcomb"), incorporated herein by reference, discloses a "spray nozzle assembly for use with aerosol can" having a valve actuating spray nozzle designed to replace the original spray nozzle, a length of flexible tubing having one end detachably connected over the spray orifice of the valve operating spray nozzle, and a remote spray nozzle removably connected to an opposite end of the flexible tubing. A plurality of stiff-walled pipes are slidably situated over the tubing between the two nozzles. When one or more of these pipes are hand held to be in bearing relation to the remote nozzle and to each other, the flexible tubing is held in a stiff condition so that the remote nozzle may be properly positioned with respect to the work area. Where it is necessary that the remote nozzle pass through a tortuous path in arriving in alignment with the work area, these stiff-walled pipes will be slid to position adjacent the valve actuating nozzle so that the remote nozzle and flexible tubing can be threaded into the desired position. However, Holcomb does not disclose an distal actuator at the end of the flexible tubing, nor does it disclose a mechanism for automatically preventing the backflow of liquid through the valve actuating spray nozzle when it is disconnected form the aerosol can.

U.S. patent application Ser. No. 13/046,057 (Pat. App. Pub. No. 2011/0240771) to Legeza ("Legeza"), incorporated herein by reference, discloses a pressurized fluid spray container extension device which has a trigger at the spray container to actuate a remote spray nozzle at the end of an extension tube to deliver a spray upon objects at a distance from the container. However, Legeza does not disclose a mechanism for preventing the backflow of liquid from the extension tube or from the extension device and toward the spray container when the extension device is disconnected from the spray container, nor does Legeza disclose a distal actuator located apart from the spray container.

U.S. patent application Ser. No. 15/231,004 (Pat. App. Pub. No. 2018/0037400) to Kuntzelman ("Kuntzelman"), incorporated herein by reference, discloses an aerosol discharge assembly including an aerosol cap sized to frictionally fit atop a cylindrically-shaped aerosol can having a centrally located longitudinal axis and circular cross-section, the cylindrically-shaped aerosol can containing a pressurized fluid therein and a valve stem which, when depressed, discharges fluid there through. The aerosol cap is also cylindrically shaped having a longitudinal axis coextensive with the longitudinal axis of the cylindrically-shaped aerosol can. The aerosol cap further includes an open channel located along its longitudinal axis exposing the valve stem there through and a hose receiving channel exposed atop the aerosol cap. An actuator is sized to slip fit within the open channel and to slide within it when being depressed by a user, the actuator including a fluid inlet port sized to receive the valve stem and a fluid output port in fluid communication with the fluid inlet port such that when the actuator is depressed, pressurized fluid from the aerosol can is caused to enter the fluid inlet port, travel through the actuator and discharge through the fluid outlet port. The assembly also includes a flexible hose having a first end and a second end, the first end being sized to capture the fluid outlet port, the second end including a fixture for passing the pressurized fluid there through, the flexible hose being sized to frictionally fit within the hose receiving channel when not in use, the assembly also including a safety tab positioned atop and emanating from the actuator which when in place, prevents the actuator from being depressed within the open channel. However, Kuntzelman does not disclose a mechanism for automatically preventing the backflow of the pressurized fluid from the flexible hose or from the aerosol discharge assembly and toward the aerosol can, nor does Kuntzelman disclose an distal actuator located apart from the aerosol can or a distal spray nozzle.

Disclosure of the Invention

The objects of the present invention and other objects are preferably achieved by a device attachable to an aerosol spray can containing pressurized liquid, the can having a valve stem that releases the pressurized liquid from the can through the valve stem when the valve stem is pressed (actuated), and a raised lip surrounding the valve stem, comprising: a snap on cap that preferably removably sealingly snaps onto the lip having a channel that is positioned over the valve stem when the cap is snapped onto the lip; an internal ridge in the channel that preferably presses the valve stem without blocking the channel when the cap is snapped onto the lip; a one-way valve in fluid communication with the channel having a cap end and a tube end, preferably attached at the cap end to the snap on cap, wherein the pressurized liquid can flow from the cap end to the tube end, but not from the tube end to the cap end, whereby backflow of the pressurized liquid from the tube end to the cap end is preferably prevented; a barbed outlet (or ridged or serrated outlet) preferably mounted on the tube end of the one-way valve; a flexible tube having a proximal end, a distal end, a length and a diameter, the proximal end being preferably removably sealingly attached to the barbed outlet; and an actuator with a barbed inlet (or ridged or serrated inlet) having a distal spray nozzle providing a desired spray pattern, wherein the distal end of the tube is preferably removably sealingly attached to the barbed inlet, whereby the distal nozzle and the barbed inlet are in fluid communication with the tube; wherein the actuator and the distal spray nozzle can be preferably placed at any desired location allowed by said length of said flexible tube, at any desired orientation, while preferably keeping the can in a substantially upright position to maximize continuous spraying, whereby when the cap is snapped onto the lip, the ridge presses down on the valve stem, and the pressurized liquid preferably flows through the channel, the one-way valve, the barbed outlet and the tube to the actuator; whereby, when the actuator is actuated, the pressurized liquid preferably flows through the actuator and the distal spray nozzle, and the pressurized liquid is preferably sprayed in the desired spray pattern at the desired location in the desired orientation; wherein when the cap is removed from the lip, the valve stem is released to stop the flow of pressurized liquid through the valve stem, and the one-way valve preferably and automatically retains the pressurized liquid within the tube to prevent backflow of the pressurized liquid from the tube through the channel; and wherein the one-way valve also preferably and automatically prevents backflow of the pressurized liquid from the channel by retaining the pressurized liquid in the channel.

The above and other objects of the present invention are also preferably achieved by a device attachable to an aerosol spray can containing pressurized liquid, the can having a valve stem that releases the pressurized liquid from the can through the valve stem when the valve stem is pressed, and a raised lip surrounding the valve stem, comprising: a snap on cap that preferably removably sealingly snaps onto the lip having a channel that is positioned over the valve stem when the cap is snapped onto the lip; at least one internal ridge in the channel that preferably presses the valve stem without blocking the channel when the cap is snapped onto the lip; a one-way valve in fluid communication with the channel having a cap end and a tube end, preferably attached at the cap end to the snap on cap, wherein the pressurized liquid can flow from the cap end to the tube end, but not from the tube end to the cap end, whereby backflow of the pressurized liquid from the tube end to the cap end is preferably prevented; an outlet preferably mounted on the tube end of the one-way valve; a flexible tube having a proximal end, a distal end, a length and a diameter, the proximal end being attached to the outlet; and an actuator with a barbed inlet having a distal spray nozzle preferably providing a desired spray pattern, wherein the distal end of the tube is preferably removably sealingly attached to the barbed inlet, whereby the distal nozzle and the barbed inlet are in fluid communication with the tube; wherein the actuator and the distal spray nozzle can be preferably placed at any desired location allowed by said length of said flexible tube, preferably at any desired orientation, while preferably keeping the can in a substantially upright position to maximize continuous spraying, whereby when the cap is snapped onto the lip, the ridge presses down on the valve stem, and the pressurized liquid preferably flows through the channel, the one-way valve, the outlet and the tube to the actuator; wherein when the cap is removed from the lip, the valve stem is released to stop the flow of pressurized liquid through the valve stem, and the one-way valve preferably and automatically retains the pressurized liquid within the tube to prevent backflow of the pressurized liquid from the tube through the channel; and wherein the one-way valve also preferably and automatically prevents backflow of the pressurized liquid from the channel by retaining the pressurized liquid in the channel.

The above and other objects of the present invention are also preferably achieved by a device attachable to an aerosol spray can containing pressurized liquid, the can having a valve stem that releases the pressurized liquid from the can through the valve stem when the valve stem is pressed, and a raised lip surrounding the valve stem, comprising: a snap on cap that preferably removably sealingly snaps onto the lip having a channel that is positioned over the valve stem when the cap is snapped onto the lip; at least one internal ridge in the channel that preferably presses the valve stem without blocking the channel when the cap is snapped onto the lip; a one-way valve in fluid communication with the channel having a cap end and a tube end, preferably attached at the cap end to the snap on cap, wherein the pressurized liquid can flow from the cap end to the tube end, but not from the tube end to the cap end, whereby backflow of the pressurized liquid from the tube end to the cap end is preferably prevented; an outlet preferably mounted on the tube end of the one-way valve; a flexible tube having a proximal end, a distal end, a length and a diameter, the proximal end being preferably attached to the outlet; and an actuator with an inlet preferably having a distal spray nozzle providing a desired spray pattern, wherein the distal end of the tube is preferably attached to the inlet, whereby the distal nozzle and the inlet are in fluid communication with the tube; wherein the actuator and the distal spray nozzle can preferably be placed at any desired location allowed by said length of said flexible tube, preferably at any desired orientation, while preferably keeping the can in a substantially upright position to maximize continuous spraying, whereby when the cap is snapped onto the lip, the ridge presses down on the valve stem, and the pressurized liquid preferably flows through the channel, the one-way valve, the outlet and the tube to the actuator; wherein when the cap is removed from the lip, the valve stem is released to stop the flow of pressurized liquid through the valve stem, and the one-way valve preferably and automatically retains the pressurized liquid within the tube to prevent backflow of the pressurized liquid from the tube through the channel; and wherein the one-way valve also preferably and automatically prevents backflow of the pressurized liquid from the channel by retaining the pressurized liquid in the channel.

In any of the preferred embodiments above, the one-way valve and the outlet are preferably integrally formed at the tube end.

In any of the preferred embodiments above, the cap and the one-way valve are preferably integrally formed at the cap end, and the one-way valve and the outlet are preferably integrally formed at the tube end.

In any of the preferred embodiments above, the distal nozzle is preferably interchangeable to provide a different desired spray pattern.

In any of the preferred embodiments above, the actuator and the distal spray nozzle are preferably integrally formed.

In any of the preferred embodiments above, the length of the tube is preferably between 3 feet and 5 feet.

In any of the preferred embodiments above, the diameter of the tube is preferably between 1.5 millimeters and 4.0 millimeters.

In any of the preferred embodiments above, the length of the tube is optimal between 3.5 feet and 4.5 feet.

In any of the preferred embodiments above, the diameter of the tube is optimal between 2.3 millimeters and 3.2 millimeters.

BEST MODE FOR CARRYING OUT THE INVENTION

The presently preferred best modes for carrying out the present invention are illustrated by way of example in FIGS. 1-5.

Figure 1:
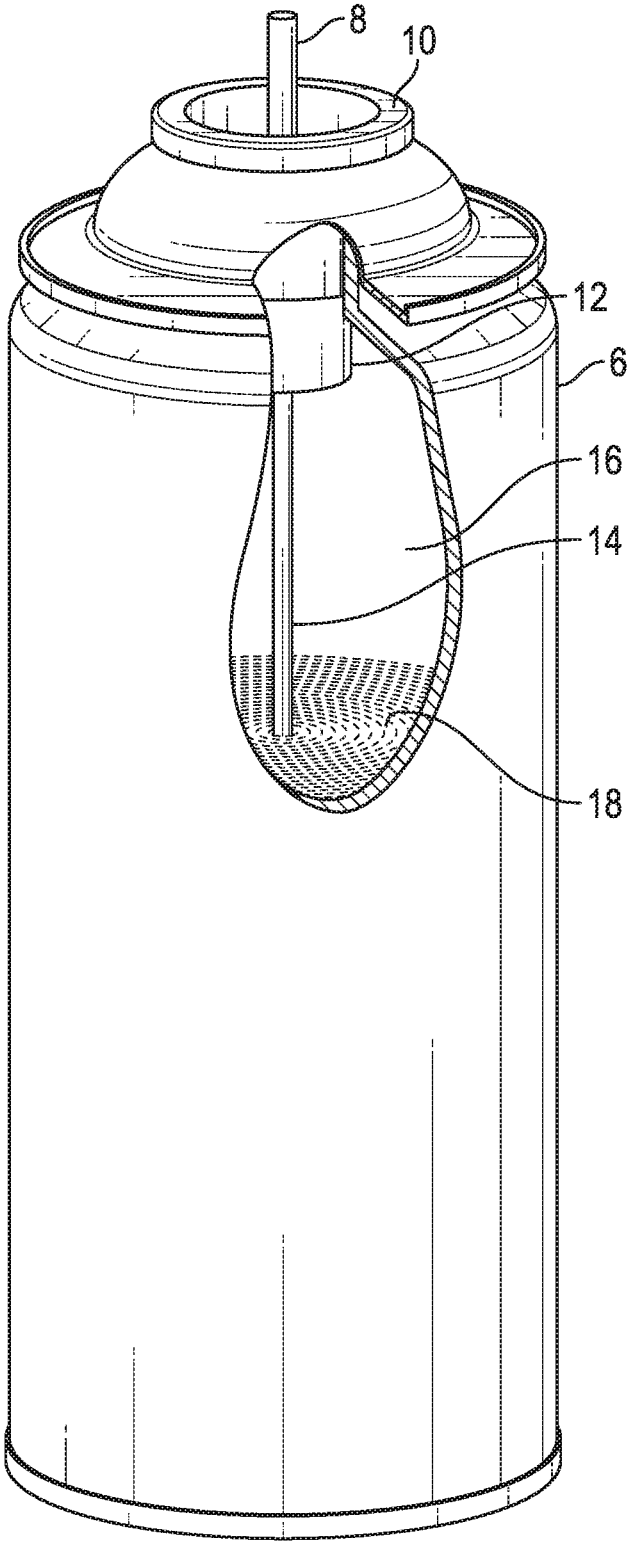
FIG. 1 is a partial cut away view of an aerosol spray can.

The device of this invention attaches to an aerosol spray can. FIG. 1 depicts a conventional aerosol spray can 6 with its spray nozzle removed, exposing a valve stem 8 with a lip 10 surrounding the valve stem 8. The valve stem 8 is operably connected to a spring-loaded valve 12, which in turn is in fluid communication with a dip tube 14. The aerosol spray can 6 contains a pressurized propellant gas 16, which (when the can is upright) exerts downward pressure on the liquid (fluid) in the can, thereby creating pressurized liquid 18. When the aerosol spray can 6 is in a substantially upright position as shown in FIG. 1, the dip tube 14 extends into, and is in fluid connection with, the pressurized liquid 18 near or at the bottom of the can. Thus, when the valve stem 8 is actuated (pressed), the spring-loaded valve 12 opens, and the pressure exerted by the propellant gas 16 pushes the pressurized liquid 18 up through the dip tube 14, through the spring-loaded valve 12, and through and out of the valve stem 8.

However, sometimes it is desirable to orient a spray can at different angles to reach certain areas or to achieve certain spray patterns, and problems arise when the aerosol spray can 6 is oriented in such a manner that the bottom end of the dip tube 14 does not extend fully into (is not fully submerged in) the pressurized liquid 18. In such circumstances, if the valve stem 8 is pressed down, the spring-loaded valve 12 opens, and only small or uneven amounts of pressurized liquid 18, or only propellant gas 16, or nothing at all, flows through the dip tube 14, the spring-loaded valve 12, and the valve stem 8. A similar outcome results when the aerosol spray can 6 contains no pressurized liquid 18 at all. This prevents the continuous spraying of pressurized liquids 18 at certain angles when the bottom of the dip tube 14 does not extend fully into (is not fully submerged in) the pressurized liquid 18.

Figure 2:
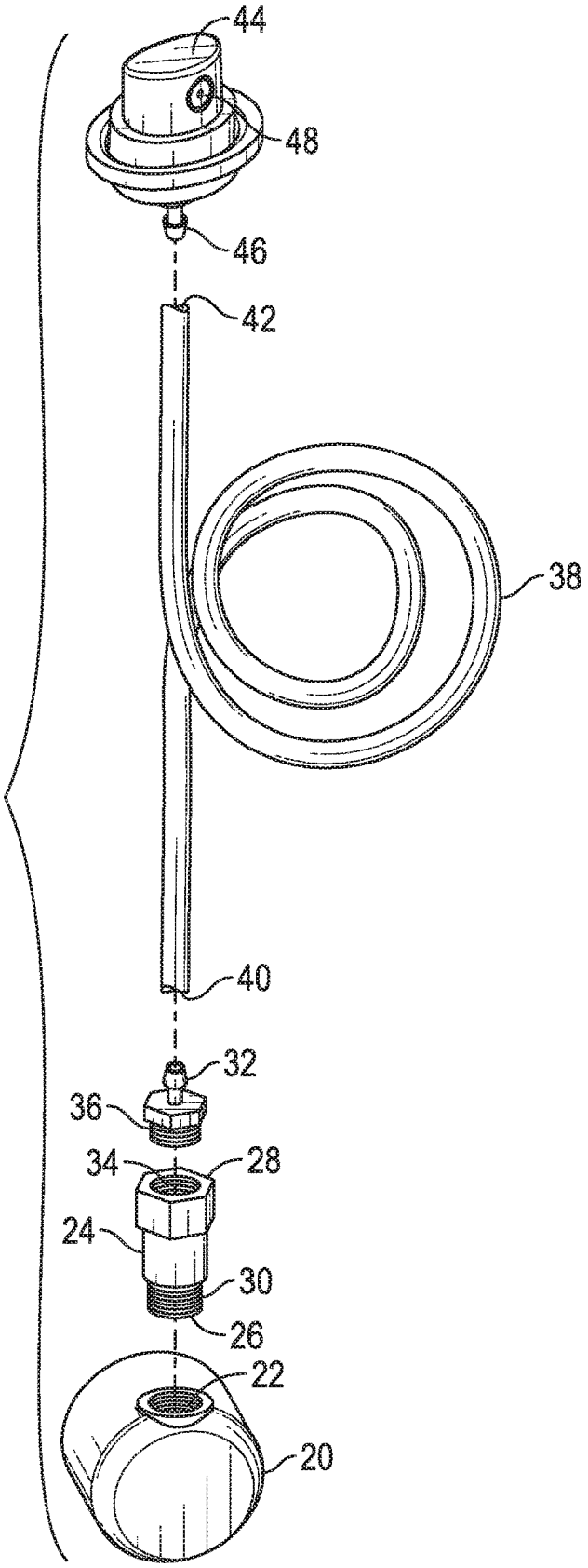
FIG. 2 is an exploded perspective view from the front of a presently preferred embodiment of the invention.

Referring to FIG. 2, shown is an exploded perspective view from the front of a presently preferred embodiment of the invention. The snap on cap 20 is preferably formed of any durable, yet flexible, material, to removably sealingly snap onto the lip 10 of the aerosol spray can 6 of FIG. 1, such as plastic, wood, rubber, or the like. Those of ordinary skill in the art will also appreciate that the snap on cap 20 may employ other means to removably sealingly snap onto an aerosol spray can 6, such as, by way of limited example, flexible tabs, springs, or the like. The snap on cap 20 preferably has an aperture extending there through preferably having internal cap screw threads 22 defined therein, leading to, and forming, a channel 50 (see FIG. 3).

The device further preferably comprises a one-way valve 24 that only allows fluid or gas to flow through it in one direction. The one-way valve 24 has a cap end 26 and a tube end 28, attached at the cap end 26 to the snap on cap 20 through external valve screw threads 30 on the cap end 26. The internal cap screw threads 22 preferably are complementary with the external valve screw threads 30, so that the one-way valve 24 can be screwed into the snap on cap 20. However, those of ordinary skill in the art will appreciate that the one-way valve 24 may be removably, sealingly attached to the snap on cap 20 using any other attachment means known in the art, including friction retention, or the use of compression fittings, clamp fittings, push-to-connect fittings, couplings, or adapters, or the like. The snap on cap 20 and the one-way valve 24 may also preferably be integrally formed. The one-way valve 24 is preferably made of any durable material, such as nickel, bronze, steel or plastic. Threaded one-way valves are conventional and well-known in the art, for example, McMaster-Carr® threaded check valves (one-way valves) (such as model numbers 47715K41, 47715K42, 47715K43, 47715K44, 47715K45, 47715K46, 47715K47, 47715K48, 7768K21, and 7768K22), but any similar or equivalent one-way valve can be used with the presently preferred embodiments of the invention.

Figure 3:
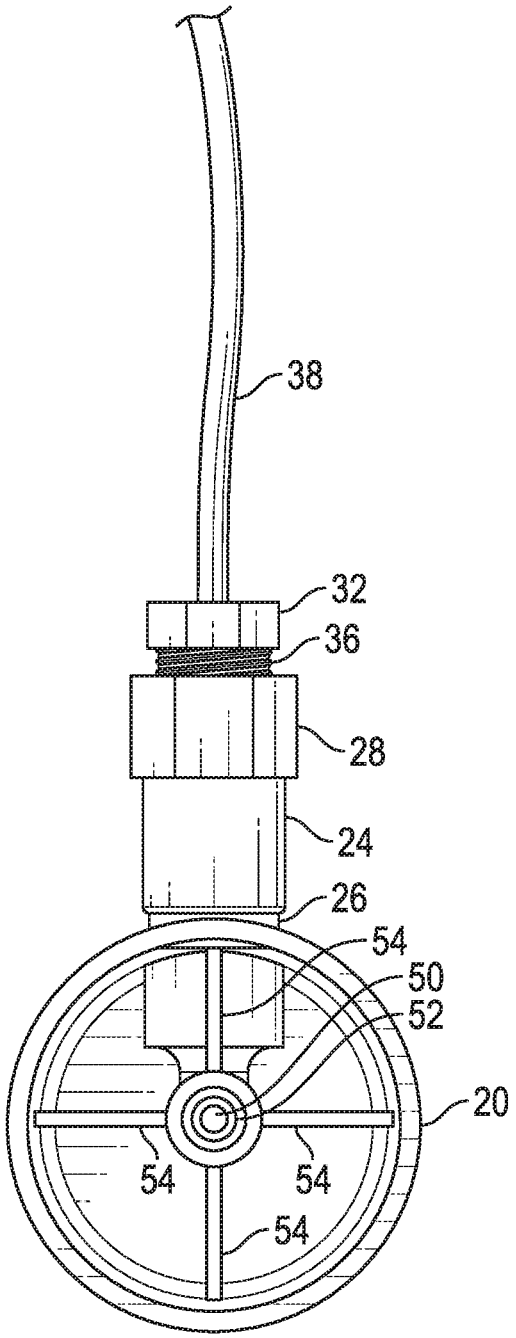
FIG. 3 is an elevational view from the rear of the lower portion of the presently preferred embodiment of FIG. 1, showing the snap on cap, one-way valve, barbed outlet, and a portion of a flexible tube, all assembled.

The one-way valve 24 preferably is connected to the snap on cap 20 so that it is in fluid communication with the channel 50 (shown in FIG. 3). Fluid communication between the channel and the one-way valve can alternatively be accomplished by way of a serrated, barbed or ridged nozzle mounted onto the snap on cap 20 (cap nozzle) and in fluid communication with the channel 50, a short connecting tube, having a cap end and a valve end, removably sealingly attached to the cap nozzle at the cap end, and a one-way valve having a barbed inlet (a barbed valve inlet) and a barbed outlet (a barbed valve outlet), removably sealingly attached to the valve end of the connecting tube at the barbed valve inlet. One-way valves having barbed inlets and barbed outlets are conventional and well-known in the art, for example, McMaster-Carr® barbed check valves (one-way valves) (such as model numbers 47245K25, 47245K17, 47245K26, 47245K27, and 47245K24), but any similar or equivalent one-way valve can be used. The barbed valve outlet can thereafter be removably sealingly attached to the flexible tube 38 described below.

Referring back to FIG. 2, an outlet that is ridged, serrated, or barbed (barbed outlet) 32 is preferably removably sealingly attached to the tube end 28 of the one-way valve 24. This is accomplished through internal valve screw threads 34 on the tube end 28 of the one-way valve 24 that preferably engage with complementary external outlet screw threads 36 on the barbed outlet 32. However, those of ordinary skill in the art will appreciate that the barbed outlet 32 can be removably sealingly attached to the tube end 28 of the one-way valve 24 using any attachment method known in the art, including friction retention, or the use of compression fittings, clamp fittings, push-to-connect fittings, couplings, or adapters, or the like. The barbed outlet 32 and the one-way valve 24 may also be integrally formed. One-way valves with one barbed fitting are convention and well-known in the art, for example, McMaster-Carr® check valves with barbed fittings (such as model numbers 2987K35, 2987K36, and 2987K38), but any similar or equivalent one-way valve can be used.

A flexible tube 38 having a proximal end 40, a distal end 42, a length, and a diameter is preferably removably sealingly attached at the proximal end 40 to the barbed outlet 32. The proximal end 40 of the flexible tube 38 is preferably removably sealingly attached to the barbed outlet 32 by inserting the barbed outlet 32 into the proximal end 40 of the flexible tube 38 such that barbed outlet 32 is frictionally retained within the flexible tube 38. The diameter of the flexible tube is preferably the same or slightly less than the diameter of the barbed outlet 32, so that the proximal end 40 of the flexible tube 38 is removably sealingly attached to the barbed outlet 32. However, those of ordinary skill in the art will appreciate that the proximal end 40 of the flexible tube 38 may also preferably be removably sealingly attached to an outlet that is not barbed, ridged, serrated, or the like, using any attachment method known in the art, including friction retention, or the use of compression fittings, clamp fittings, push-to-connect fittings, couplings, or adapters. The proximal end 40 of the flexible tube 38 may also preferably be integrally formed with the barbed outlet 32 or the one-way valve 24.

The length of the flexible tube 38 is preferably between 3 feet and 5 feet, and optimally between 3.5 feet and 4.5 feet. The diameter of the flexible tube 38 is preferably between 1.5 millimeters and 4.0 millimeters, and optimally between 2.3 millimeters and 3.2 millimeters.

The device further preferably comprises an actuator 44 at its distal end having an inlet that is barbed (barbed inlet) 46 and a distal spray nozzle 48 providing a desired spray pattern. The barbed inlet 46 alternatively may be ridged or serrated. The distal end 42 of the flexible tube 38 is preferably removably sealingly attached to the barbed inlet 46 by pushing the distal end 42 of the flexible tube 38 over the barbed inlet 46 such that friction between the barbed inlet 46 and the flexible tube 38 frictionally sealingly retains the barbed inlet 46 within the distal end 42 of the flexible tube 38. Preferably, the diameter of the flexible tube is the same or slightly less than the diameter of the barbed inlet 46 so that the distal end 42 of the flexible tube 38 is removably sealingly attached to the barbed inlet 46. Those of ordinary skill in the art will appreciate that the distal end 42 of the flexible tube 38 may also preferably be removably sealingly attached to an inlet that is not barbed, ridged, serrated, or the like, using any attachment method known in the art, including friction retention, or the use of compression fittings, clamp fittings, push-to-connect fittings, couplings, or adapters. The distal end 42 of the flexible tube 38 may also be preferably integrally formed with the barbed inlet 46 or the actuator 44.

The presently preferred embodiment of the invention further comprises a distal spray nozzle 48 that is in fluid communication with the barbed inlet 46 and the flexible tube 38. The actuator 44 has a spring-loaded valve that is opened by pressing down on the actuator 44, thereby allowing the flow of pressurized liquid 18 through the actuator 44 and out of the distal spray nozzle 48. However, those of ordinary skill in the art will appreciate that the actuator 44 can preferably also be a trigger, a lever, an electronic button, a digitally controlled circuit, or any other means of opening a valve to permit the flow of the pressurized liquid 18 out of the distal spray nozzle 48. In a preferred embodiment, the actuator 44 and the distal spray nozzle 48 may be integrally formed. The actuator 44 may also preferably have an ergonomic handle for holding the actuator 44. In yet another preferred embodiment, the distal spray nozzle 48 is interchangeable with other distal spray nozzles to provide different desired spray patterns.

FIG. 3 is an elevational view from the rear of the lower portion of the presently preferred embodiment of FIG. 1, showing the snap on cap 20, one-way valve 24, barbed outlet 32, and flexible tube 38 all removably sealingly attached and assembled, or integrally formed. The snap on cap 20 preferably has a channel 50 extending there through, which is positioned over valve stem 8 of the aerosol can of FIG. 1 when the snap on cap 20 is snapped onto the lip 10. The channel 50 is in fluid communication with the one-way valve 24, so that the pressurized liquid 18 can flow from the cap end 26 to the tube end 28 of the one-way valve 24, but not in the opposite direction. The snap on cap 20 preferably also has an internal ridge 52 (preferably wholly or partially circular) that presses down on the valve stem 8 without blocking the channel 50 when the snap on cap 20 is snapped onto the lip 10, thereby keeping the valve stem 8 actuated until the snap on cap 20 is removed from the lip 10 and the valve stem 8 is released. In another preferred embodiment, there are one or more internal ridges (or internal tabs), which are not necessarily circular, in the channel 50 that are large enough to press (actuate) the valve stem 8 when the snap on cap 20 is snapped onto the lip 10, but small enough not to block the channel 50. However, those of ordinary skill in the art will appreciate that any internal projection that can press the valve stem without blocking the channel can be used, such as a peg, lobe, pin, or the like, all of which are hereinafter referred to as ridges. The snap on cap 20 further preferably has one or more structural supports 54 that are integrally formed with the internal ridge 52 to provide support and durability to the snap on cap 20, which is repeatedly subject to force whenever the snap on cap 20 is snapped onto the lip 10.

Figure 4:
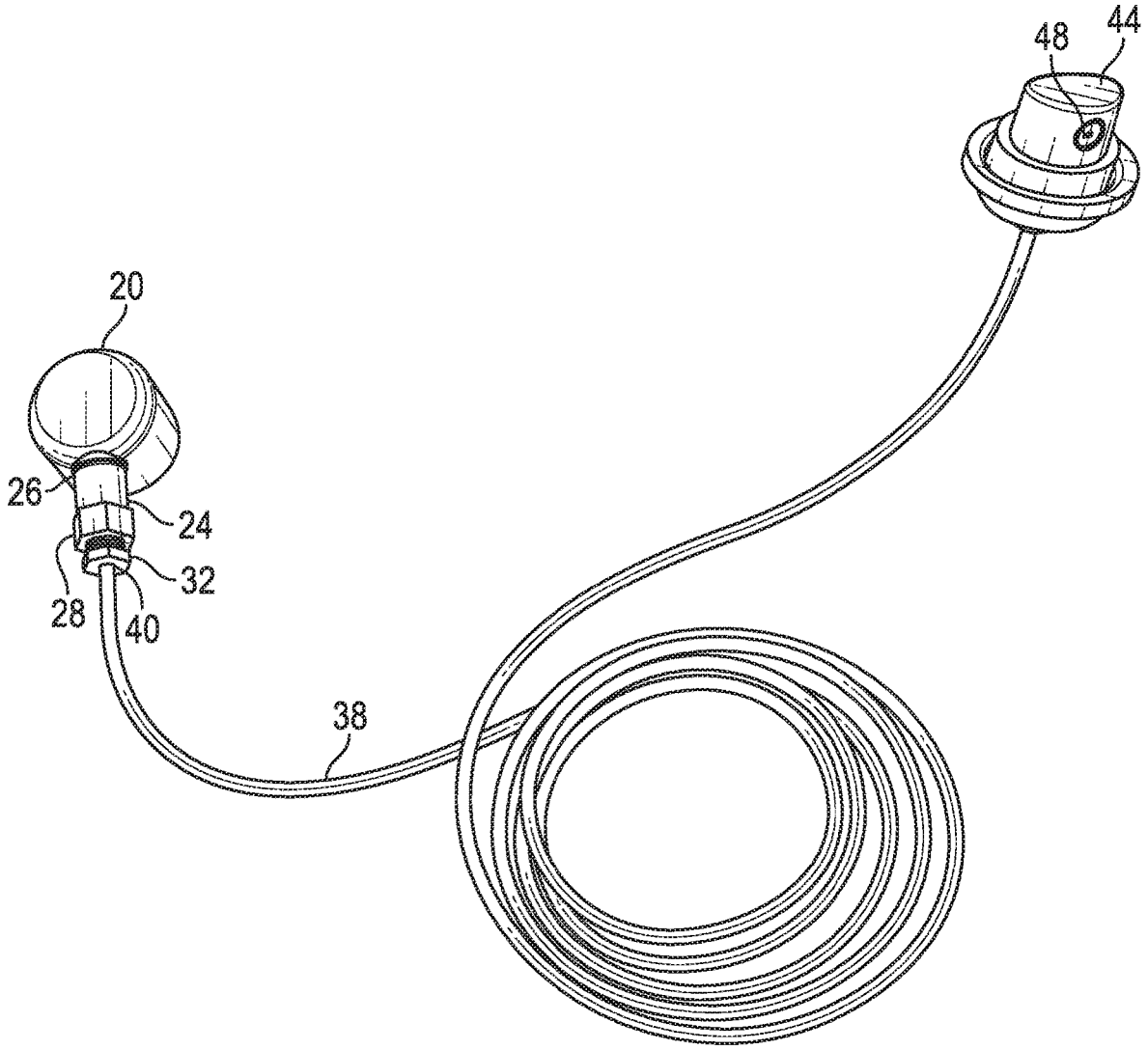
FIG. 4 is a perspective view from above of the embodiment of FIG. 2.

FIG. 4 shows the presently preferred embodiment of the invention with the snap on cap 20, one-way valve 24, barbed outlet 32, flexible tube 38, all removably sealingly attached and assembled, or integrally formed, at a proximal end, and an actuator 44 with barbed inlet 46, and the distal spray nozzle 48 all removably sealingly attached and assembled, or integrally formed, at a distal end.

Figure 5:
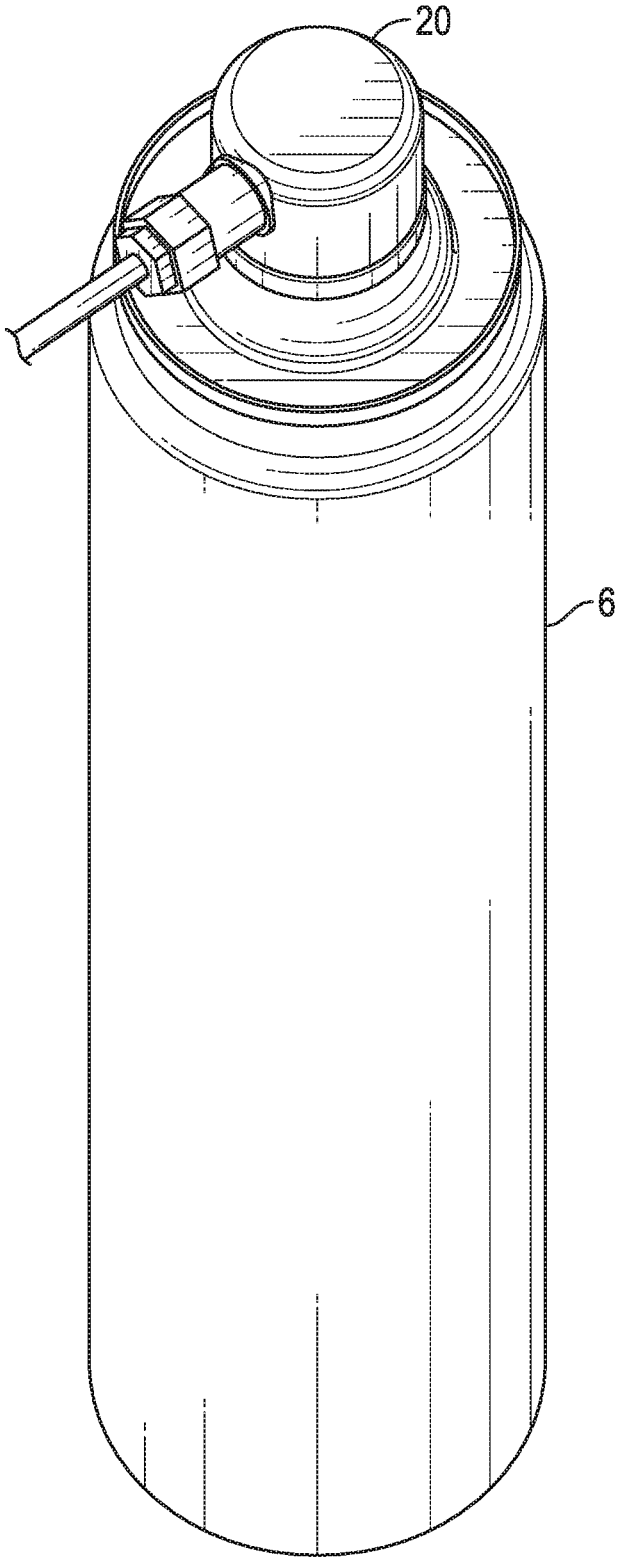
FIG. 5 is a perspective assembled view from the top, front, left of the embodiment of FIG. 2, in which the snap on cap is removably sealingly snapped onto the lip of the aerosol spray can of FIG. 1.

FIG. 5 shows the proximal end of the presently preferred embodiment of the invention, with the snap on cap 20 removably sealingly snapped onto the lip 10 of the aerosol can 6, while maintaining the aerosol can 6 in an upright position.

With reference to FIGS. 1 through 5, the device in accordance with a presently preferred embodiment of the present invention is used as follows: if the aerosol spray can 6 has an existing spray nozzle, the existing spray nozzle is removed to expose the valve stem 8. The snap on cap 20 is aligned over the aerosol spray can 6 such that its channel 50 is positioned over the valve stem 8. Downward pressure is then applied to the snap on cap 20 such that the snap on cap 20 snaps onto the lip 10 of the aerosol spray can 6. The internal ridge 52 (or alternatively one or more internal tabs or other internal projections) contacts and presses down on the valve stem 8, which releases pressurized liquid 18 into the channel 50, through the one-way valve 24, out through the barbed outlet 32, into the flexible tubing 38, through the flexible tubing 38, into the barbed inlet 46, and into the actuator 44. When the user actuates the actuator 44, the actuator 44 sprays the pressurized liquid 18 through the distal spray nozzle 48 in the desired spray pattern, at a desired location, and in a desired orientation.

When the snap on cap 20 is removed from the lip 10 of the aerosol spray can 6, the valve stem 8 is released, which stops the flow of pressurized liquid 18 from the can 6 through the valve stem 8. The one-way valve 24 automatically prevents backflow of the pressurized liquid 18 in the flexible tube 38 into the channel 50, thus retaining the pressurized liquid 18 within the flexible tube 38. Surprisingly, the one-way valve 24 also automatically prevents backflow of the pressurized liquid 18 in the small and narrow channel 50 of the snap on cap 20 due to atmospheric pressure. Much as a drinking straw retains liquid inside when a finger blocks the upper end of the straw when the straw is in a drink (to prevent air from entering the upper end of the straw), and then the straw is withdrawn upwards with the finger still blocking the upper end, atmospheric pressure retains the pressurized liquid 18 in the channel 50 because the one-way valve 24 blocks air or backflow of pressurized gas and/or fluid from the flexible tube 38 (or elsewhere) into the channel 50, so that the atmospheric pressure outside the channel 50 is greater than the pressure inside the channel 50, which keeps the pressurized liquid 18 inside. Intermolecular forces between the pressurized liquid 18 and solid surfaces in the channel 50 may also assist with retaining the pressurized liquid in the channel 50. Specifically, adhesion (or the tendency of dissimilar particles or surfaces to cling to one another) attracts the pressurized liquid 18 to the walls of the channel 50, thereby keeping it in the channel 50 when the snap on cap 20 is removed from the aerosol spray can 6.

To release the pressurized liquid 18 within the flexible tube 38 after the device is disconnected from the aerosol spray can 6, a user can simply press the actuator 44 and spray the pressurized liquid 18 in the flexible tube 38 through the distal spray nozzle 48 in any desired location.

Thus, by using the device in accordance with the preferred embodiments of the present invention, pressurized liquid can be sprayed through a distal spray nozzle that can be oriented at any angle and sprayed at a desired location, while maintaining the aerosol spray can in a substantially upright position to maximize continuous and consistent spraying of the pressurized liquid. Further, the device in accordance with the preferred embodiments solves the problem of backflow through the use of a one-way valve that automatically retains the pressurized liquid within the flexible tube to prevent backflow of the pressurized liquid from the flexible tube into the channel when the device is disconnected from the aerosol spray can. The one-way valve also automatically prevents backflow of the pressurized liquid from the channel out of the device by retaining the pressurized liquid in the small and narrow channel due to atmospheric pressure and intermolecular forces, similar to a drinking straw blocked by a finger.

While the present invention has been disclosed in connection with the presently preferred embodiments described herein, it should be understood that there may be other embodiments which fall within this spirit and scope of the invention as defined by the claims. Accordingly, no limitations are to be implied or inferred in this invention except as specifically and as explicitly set forth in the claims.

INDUSTRIAL APPLICABILITY

This invention can be used whenever it is necessary or desirable to continuously spray pressurized liquid from an aerosol spray can at any angle and in any location while automatically preventing backflow of the pressurized liquid through the device when it is removed from the aerosol spray can.

I claim:

1. A device attachable to an aerosol spray can containing pressurized liquid, said can having a valve stem that releases said pressurized liquid from said can through said valve stem when said valve stem is pressed, and a raised lip surrounding said valve stem, comprising:

a snap on cap that removably sealingly snaps onto said lip having a channel that is positioned over said valve stem when said cap is snapped onto said lip;

an internal ridge in said channel that presses said valve stem without blocking said channel when said cap is snapped onto said lip;

a one-way valve in fluid communication with said channel having a cap end and a tube end, attached at said cap end to said snap on cap, wherein said pressurized liquid can flow from said cap end to said tube end, but not from said tube end to said cap end, whereby backflow of said pressurized liquid from said tube end to said cap end is prevented;

a barbed outlet mounted on said tube end of said one-way valve;

a flexible tube having a proximal end, a distal end, a length and a diameter, said proximal end being removably sealingly attached to said barbed outlet; and an actuator with a barbed inlet having a distal spray nozzle providing a desired spray pattern, wherein said distal end of said tube is removably sealingly attached to said barbed inlet, whereby said distal nozzle and said barbed inlet are in fluid communication with said tube;

wherein said actuator and said distal spray nozzle can be placed at any desired location allowed by said length of said flexible tube, at any desired orientation, while keeping said can in a substantially upright position to maximize continuous spraying, whereby when said cap is snapped onto said lip, said ridge presses down on said valve stem, and said pressurized liquid flows through said channel, said one-way valve, said barbed outlet and said tube to said actuator;

whereby, when said actuator is actuated, said pressurized liquid flows through said actuator and said distal spray nozzle, and said pressurized liquid is sprayed in said desired spray pattern at said desired location in said desired orientation;

wherein when said cap is removed from said lip, said valve stem is released to stop said flow of pressurized liquid through said valve stem, and said one-way valve automatically retains said pressurized liquid within said tube to prevent backflow of said pressurized liquid from said tube through said channel; and wherein said one-way valve also automatically prevents backflow of said pressurized liquid from said channel by retaining said pressurized liquid in said channel when said cap is removed from said lip and said pressurized liquid in said channel is exposed to atmospheric pressure.

2. A device attachable to an aerosol spray can containing pressurized liquid, said can having a valve stem that releases said pressurized liquid from said can through said valve stem when said valve stem is pressed, and a raised lip surrounding said valve stem, comprising:

a snap on cap that removably sealingly snaps onto said lip having a channel that is positioned over said valve stem when said cap is snapped onto said lip;

at least one internal ridge in said channel that presses said valve stem without blocking said channel when said cap is snapped onto said lip;

a one-way valve in fluid communication with said channel having a cap end and a tube end, attached at said cap end to said snap on cap, wherein said pressurized liquid can flow from said cap end to said tube end, but not from said tube end to said cap end, whereby backflow of said pressurized liquid from said tube end to said cap end is prevented;

an outlet mounted on said tube end of said one-way valve;

a flexible tube having a proximal end, a distal end, a length and a diameter, said proximal end being attached to said outlet; and an actuator with a barbed inlet having a distal spray nozzle providing a desired spray pattern, wherein said distal end of said tube is removably sealingly attached to said barbed inlet, whereby said distal nozzle and said barbed inlet are in fluid communication with said tube;

wherein said actuator and said distal spray nozzle can be placed at any desired location allowed by said length of said flexible tube, at any desired orientation, while keeping said can in a substantially upright position to maximize continuous spraying, whereby when said cap is snapped onto said lip, said ridge presses down on said valve stem, and said pressurized liquid flows through said channel, said one-way valve, said outlet and said tube to said actuator;

wherein when said cap is removed from said lip, said valve stem is released to stop said flow of pressurized liquid through said valve stem, and said one-way valve automatically retains said pressurized liquid within said tube to prevent backflow of said pressurized liquid from said tube through said channel; and wherein said one-way valve also automatically prevents backflow of said pressurized liquid from said channel by retaining said pressurized liquid in said channel when said cap is removed from said lip and said pressurized liquid in said channel is exposed to atmospheric pressure.

3. A device attachable to an aerosol spray can containing pressurized liquid, said can having a valve stem that releases said pressurized liquid from said can through said valve stem when said valve stem is pressed, and a raised lip surrounding said valve stem, comprising:

a snap on cap that removably sealingly snaps onto said lip having a channel that is positioned over said valve stem when said cap is snapped onto said lip;

at least one internal ridge in said channel that presses said valve stem without blocking said channel when said cap is snapped onto said lip;

a one-way valve in fluid communication with said channel having a cap end and a tube end, attached at said cap end to said snap on cap, wherein said pressurized liquid can flow from said cap end to said tube end, but not from said tube end to said cap end, whereby backflow of said pressurized liquid from said tube end to said cap end is prevented;

an outlet mounted on said tube end of said one-way valve;

a flexible tube having a proximal end, a distal end, a length and a diameter, said proximal end being attached to said outlet; and an actuator with an inlet having a distal spray nozzle providing a desired spray pattern, wherein said distal end of said tube is attached to said inlet, whereby said distal nozzle and said inlet are in fluid communication with said tube;

wherein said actuator and said distal spray nozzle can be placed at any desired location allowed by said length of said flexible tube, at any desired orientation, while keeping said can in a substantially upright position to maximize continuous spraying, whereby when said cap is snapped onto said lip, said ridge presses down on said valve stem, and said pressurized liquid flows through said channel, said one-way valve, said outlet and said tube to said actuator;

wherein when said cap is removed from said lip, said valve stem is released to stop said flow of pressurized liquid through said valve stem, and said one-way valve automatically retains said pressurized liquid within said tube to prevent backflow of said pressurized liquid from said tube through said channel; and wherein said one-way valve also automatically prevents backflow of said pressurized liquid from said channel by retaining said pressurized liquid in said channel when said cap is removed from said lip and said pressurized liquid in said channel is exposed to atmospheric pressure.

4. The device of any one of claim 1, 2 or 3 wherein said one-way valve and said outlet are integrally formed at said tube end.

5. The device of any one of claim 1, 2 or 3 wherein said cap and said one-way valve are integrally formed at said cap end, and said one-way valve and said outlet are integrally formed at said tube end.

6. The device of any one of claim 1, 2 or 3 wherein said actuator and said distal spray nozzle are integrally formed.

7. The device of any one of claim 1, 2 or 3 wherein said length of said tube is between 3 feet and 5 feet.

8. The device of claim 1, 2, or 3 wherein said diameter of said tube is between 1.5 millimeters and 4.0 millimeters.

9. The device of claim 1, 2 or 3 wherein said length of said tube is between 3.5 feet and 4.5 feet.

10. The device of claim 1, 2, or 3 wherein said diameter of said tube is between 2.3 millimeters and 3.2 millimeters.

* * * * *